US006076674A

United States Patent [19]

Christ et al.

[11] Patent Number: 6,076,674

[45] Date of Patent: Jun. 20, 2000

[54] WRAPPED MATERIAL, AND METHOD AND APPARATUS FOR WRAPPING SUCH MATERIAL

[75] Inventors: Dennis L. Christ, Scandia; Donald R. Peacock, St. Paul, both of Minn.

[73] Assignee: 3M Innovative Properties Company, St. Paul, Minn.

[21] Appl. No.: 09/085,493

[22] Filed: May 27, 1998

[51] Int. Cl.[7] ..... B65D 65/00

[52] U.S. Cl. ..... 206/447; 206/412; 206/813

[58] Field of Search ..... 206/447, 524.1, 206/524.6, 525, 813, 412

[56] References Cited

U.S. PATENT DOCUMENTS

| | | | |
|---|---|---|---|
| 2,303,826 | 12/1942 | De Bell | 206/447 |
| 2,762,504 | 9/1956 | Sparks et al. | 206/84 |
| 2,975,150 | 3/1961 | Johnson et al. | 260/27 |
| 3,075,640 | 1/1963 | Snyder | 206/447 |
| 3,317,368 | 5/1967 | Battersby | 161/175 |
| 3,418,059 | 12/1968 | Robe | 401/266 |
| 3,644,169 | 2/1972 | Phillips | 99/135 |
| 3,917,123 | 11/1975 | Grenfell | 222/146 |
| 3,986,640 | 10/1976 | Redmond | 222/92 |
| 4,054,632 | 10/1977 | Franke | 264/145 |
| 4,093,485 | 6/1978 | Ornsteen | 156/244.13 |
| 4,112,158 | 9/1978 | Creekmore et al. . | |
| 4,248,348 | 2/1981 | Butler et al. . | |
| 4,490,424 | 12/1984 | Gerace | 428/68 |
| 4,755,245 | 7/1988 | Viel | 156/227 |
| 4,774,123 | 9/1988 | Dziki | 428/156 |
| 4,871,590 | 10/1989 | Merz et al. | 427/387 |
| 4,925,512 | 5/1990 | Briand | 156/201 |
| 5,257,491 | 11/1993 | Rouyer et al. | 53/428 |
| 5,333,439 | 8/1994 | Bozich et al. | 53/450 |
| 5,373,682 | 12/1994 | Hatfield et al. | 53/440 |
| 5,392,592 | 2/1995 | Bozich et al. | 53/440 |
| 5,443,903 | 8/1995 | Hansen | 428/355 |
| 5,848,696 | 12/1998 | Christ et al. | 206/447 |

FOREIGN PATENT DOCUMENTS

| | | |
|---|---|---|
| 2753715 | 3/1998 | France . |
| 1 963 884 | 12/1969 | Germany . |
| 32 34 065 A1 | 4/1983 | Germany . |
| 31 38 222 C1 | 5/1983 | Germany . |
| 1095735 | 12/1967 | United Kingdom . |
| 2 135 238 | 8/1984 | United Kingdom . |
| 93/23224 | 11/1993 | WIPO . |
| 98/23488 | 6/1998 | WIPO . |

*Primary Examiner*—Jacob K. Ackun

[57] ABSTRACT

A wrapped mass of material. A preferred embodiment of the invention provides a cold-flowable material such as a hot-melt adhesive wrapped in a liner such that the liner is easily removed from the material. The present invention also provides a method and apparatus for wrapping the material with the liner. The wrapped mass of material comprises a flexible liner and a mass of material including a peripheral surface. The liner includes an inside surface, an outside surface opposite the inside surface, a first edge, and a second edge opposite the first edge. The inside surface of the liner is at least partially wrapped around the peripheral surface of the mass of material forming a wrapped mass of material. The wrapped mass of material is spirally wound about itself.

23 Claims, 12 Drawing Sheets

WRAPPED MATERIAL, AND METHOD AND APPARATUS FOR WRAPPING SUCH MATERIAL

TECHNICAL FIELD

The present invention relates generally to a wrapped mass of material and to methods and apparatus for wrapping such material. The present invention relates more particularly to a cold-flowable material, such as a hot-melt adhesive, wrapped in a liner.

BACKGROUND OF THE INVENTION

There have been several attempts to provide a means to package and handle materials such a hot melt adhesives or pressure sensitive adhesives. For example, U.S. Pat. No. 5,392,592, "Hot-Melt Pressure Sensitive Adhesive Packaging, Preform, and Method," (Bozich et al.), describes a method for waste-free packaging for a hot-melt pressure sensitive adhesive that comprises extruding a hot-melt pressure sensitive adhesive into a continuous tubular film, wherein the film is compatible with being integrated into the composition of the hot-melt adhesive composition. In one embodiment, the preform of the packaging material of Bozich et al. comprises a continuous sheet of a heat sealable film having two opposed edges, with a patterned silicone coating on at least one face leaving an uncoated area. The uncoated area on the first edge is capable of forming a heat seal with a second uncoated area on either face in proximity to the opposite edge. The heat sealable film must be capable of being sealed by the application of heat or a hot-melt adhesive. Hot melt adhesive is then extruded into the tubular film and the tube is crimped to isolate desired amounts of adhesive between crimps. By melting the compatibly packaged hot melt adhesive in a glue pot, the compatible packaging becomes compatibly integrated into the molten hot melt adhesive composition.

U.S. Pat. No. 5,373,682, "Method for Tackless Packaging of Hot Melt Adhesives," (Hatfield et al.), discusses packaging a non-blocking hot-melt adhesive by directly pouring or pumping the molten adhesive into a cylindrical plastic tube, the tube being in contact with a heat sink. The tube comprises a thermoplastic film which is meltable together with the adhesive composition and blendable into the molten adhesive and which will not deleteriously affect the properties of the adhesive composition when blended therewith. In one embodiment, the plastic film is threaded through a film folder which folds the film and forms a lap seal around a fill pipe or mandrel. The lap seal is sealed with hot air, induction welding or ultrasonic welding. The molten hot-melt adhesive is then pumped into the tube. The adhesive filled tube is then crimped or pinched into smaller cartridge size segments.

U.S. Pat. No. 3,418,059, "Dispenser Package for Flowable Materials and Method of Forming Same," (Robe), discusses a dispenser package in the form of a flexible pouch having a constricted throat orifice separating the main portion of the pouch from a dispenser portion. A method is provided for forming the pouch by forming a tube of a thermoplastic material, and using a heat sealing device to form the material into a tube, then gathering the tube material at spaced locations and applying heat to form a thickened, stiffened portion at the throat orifice.

U.K. Patent Application GB 2,135,238A, "Producing Tubes for Packages," discusses a tube for packaging in which a mandrel is used to provide a tubular packaging means having a longitudinal seam formed as a sealed film.

This application also discusses a method of producing tubular packaging means from a flat length of film, in particular heat sealable film, which comprises folding a length of film about a sealing mandrel to bring two longitudinal edges of the film against each other alongside the sealing mandrel, sealing the two edges to form a sealed film, and drawing the tubular piece off the sealing mandrel.

U.S. Pat. No. 4,755,245, "Method for Conditioning a Permanent Adhesive Composition in the Form of Blocks or Sections," (Viel), discusses several prior proposed and implemented methods to package adhesive compositions. The methods discussed in Viel include providing permanent adhesive compositions in the form of rods, blocks, strips, sections, and slabs, which are enveloped by a thin film. Viel characterizes the method of wrapping with film as costly. Veil also points out that the choice of films suitable for such protection is fairly limited since it is absolutely essential that they blend perfectly with the composition during re-melting of the latter when used, as the protected composition is now inseparable from its protective film.

It is also known to provide hot melt adhesives in the form of a coextruded core/sheath composite, in which the sheath is relatively non-tacky and can be mixed with the material of the core upon remelt of the composite. It is also known that such composites can be coiled about a spool. See, for example, U.S. Pat. Nos. 3,317,368 and 4,490,424, and U.K. Patent Specification 1,095,735.

Co-pending U.S. patent application Ser. No. 08/753461, filed on Nov. 25, 1996, discloses an elongate mass of material wrapped by a liner in which the liner is wrapped around the material with the liner inside surface facing the peripheral surface of the material, with first and second regions of the liner extending away from the material with the liner inside surface of the first region in unbonded contact with the liner inside surface of the second region so as to enclose the material with said liner. The material and the center region of the liner together form a core of the wrapped mass of material, and the first and second liner regions together form a tab of the wrapped mass of material. The wrapped mass of material includes a first portion and a second portion and is arranged such that the core of a second portion applies sufficient force to the tab of a first portion so as to maintain the mass of material enveloped by the liner at the first portion. Also presented are methods and apparatus for wrapping and unwrapping such material.

SUMMARY OF THE INVENTION

The present invention provides a wrapped mass of material and methods and apparatus for wrapping such material. A preferred embodiment of the invention provides a cold-flowable material such as a hot-melt adhesive or pressure sensitive adhesive wrapped in a liner such that the liner is easily removed from the material.

The present invention also provides a method and apparatus for wrapping the material with the liner. The present invention is also useful for wrapping difficult to handle materials, such as materials which stick or bond to themselves. The present invention is also useful with materials which are not coherent or strong enough to be drawn through processing or delivery apparatuses themselves, but which can be easily packaged and handled according to the present invention by drawing the liner which wraps the material. This can include materials in particulate form, powders, and liquids.

One aspect of the present invention presents a wrapped mass of material. The wrapped mass of material comprises a flexible liner and a mass of material including a peripheral surface. The liner includes an inside surface, an outside surface opposite the inside surface, a first edge, and a second edge opposite the first edge. The inside surface of the liner is at least partially wrapped around the peripheral surface of the mass of material forming a wrapped mass of material. The wrapped mass of material is spirally wound about itself.

In one preferred embodiment of the above wrapped mass of material, there are consecutive spirals of the wrapped mass of material in which a second spiral of the wrapped mass of material is supported by a first spiral of wrapped mass of material adjacent the second spiral.

In another preferred embodiment of the above wrapped mass of material, the wrapped mass of material includes consecutive spirals of the wrapped mass of material and a reinforcing film interposed between the consecutive spirals of the wrapped mass of material.

In another preferred embodiment of the above wrapped mass of material, the wrapped mass of material is in combination with a core, where the wrapped mass of material is spirally wound about the core.

In another preferred embodiment of the above wrapped mass of material, the liner is under tension so as to support the mass of material inside the liner.

In another preferred embodiment of the above wrapped mass of material, the mass of material includes an elongated cross-section.

In another preferred embodiment of the above wrapped mass of material, a portion of the peripheral surface of the mass of material remains exposed between the first edge and the second edge of the liner, forming an exposed surface of the mass of material. In another aspect of this embodiment, the first edge and the second edge of the liner extend beyond the exposed surface.

In another preferred embodiment of the above wrapped mass of material, the liner includes a first exposed surface extending along the first edge and a second exposed surface extending along the second edge, and a center surface extending between the first exposed surface and the second exposed surface, where the first exposed surface of the liner and the second exposed surface of the liner are unbonded.

In another preferred embodiment of the above wrapped mass of material, the liner includes a first exposed surface extending along the first edge and a second exposed surface extending along the second edge, and a center surface extending between the first exposed surface and the second exposed surface, wherein the first exposed surface of the liner and the second exposed surface of the liner are bonded together.

In another preferred embodiment of the above wrapped mass of material, the mass of material comprises a cold-flowable material. In another aspect of this embodiment, the cold-flowable material comprises an adhesive. In yet another aspect of this embodiment, the adhesive comprises a hot-melt adhesive. In another aspect of this embodiment, the adhesive comprises a pressure sensitive adhesive. In yet another aspect of this embodiment, the cold-flowable material is subject to cold flow at 20° C. In another aspect of this embodiment, the liner is meltable and mixable with the hot melt adhesive so as to provide a coatable hot melt adhesive composition.

In another preferred embodiment of the above wrapped mass of material, the liner comprises a cloth including a silicone release coating on at least the inside surface of the liner.

In another preferred embodiment of the above wrapped mass of material, the wrapped mass of material is in combination with a pallet including a first major surface and a second major surface opposite the first major surface, wherein the wrapped mass of material is supported by the first major surface. Another aspect of this embodiment further includes a core, where the wrapped mass of material is spirally wound about the core and where the core is engaged with the first major surface of the pallet. Yet another aspect of this embodiment further includes a spacer extending from the first major surface of the pallet and a second pallet supported by the spacer, the second pallet including a first major surface and a second major surface and a second wrapped mass of material supported by the first major surface of the second pallet.

In another preferred embodiment of the above wrapped mass of material, the mass of material is continuous. In another preferred embodiment of the above wrapped mass of material, the liner is continuous.

In another aspect, the present invention provides a wrapped mass of material, comprising a mass of cold-flowable adhesive including an elongated cross-section and a peripheral surface and a flexible liner. The liner has an inside surface, an outside surface opposite the inside surface, a first edge, and a second edge opposite the first edge. The liner is wrapped around the mass, and a portion of the peripheral surface of the material remains generally exposed.

In still another aspect, the present invention provides a wrapped mass of hot melt adhesive, comprising a flexible liner and a mass of hot melt adhesive. The liner includes an inside surface, an outside surface opposite the inside surface, a first edge, and a second edge opposite the first edge, a first exposed surface extending along the first edge, a second exposed surface extending along the second edge, a center surface extending between the first exposed surface and the second exposed surface. The mass of hot melt adhesive includes a peripheral surface, where the peripheral surface is in contact with the center surface of the liner forming a wrapped mass of hot melt adhesive, where the first exposed surface and the second exposed surface of the liner to extend away from the mass of hot melt adhesive, and where the first exposed surface and the second exposed surface of the liner are unbonded. The wrapped mass of hot melt adhesive is spirally wound about itself.

The present invention also provides a method for wrapping a mass of cold-flowable material in a liner. The method includes the steps of: a) folding a liner, wherein the liner includes an inside surface, and outside surface opposite the inside surface, a first edge and a second edge opposite the first edge and wherein the fold is between the first edge and second edge, b) introducing a mass of cold-flowable material onto the liner, and c) spirally winding the wrapped mass of material about itself. In one preferred embodiment of this method, step b) proceeds step a). In another preferred embodiment of this method, step a) proceeds step b).

In yet another preferred embodiment of the above method, step b) comprises extruding the mass of cold-flowable material onto the liner. In another preferred embodiment of the above method, step b) comprises introducing a plurality of discontinuous masses of cold-flowable material onto the liner.

In another preferred embodiment of the above method, the mass of material is continuous. In another preferred embodiment of the above method, the liner is continuous.

In another preferred embodiment of the above method, the mass of cold-flowable material includes an elongated cross-section. In another aspect of this embodiment, the mass of cold-flowable material is subject to cold flow at 20° C. In yet another aspect of this embodiment, the mass of cold-flowable material comprises an adhesive. In another aspect of this embodiment, the adhesive comprises a hot melt adhesive. Another aspect of this embodiment further includes steps of d) unwinding the wrapped mass of hot melt adhesive and e)melting the mass of hot melt adhesive and the liner, wherein the liner is meltable and mixable with the hot melt adhesive so as to provide a coatable hot melt adhesive composition. In another preferred embodiment of the above method, the adhesive comprises a pressure sensitive adhesive.

In another preferred embodiment, the above method further comprises the step of d) interposing a reinforcing film between consecutive spirals; of the wrapped mass of material. In yet another preferred embodiment of the above method, step c) comprises spirally winding the wrapped mass of material about a core.

In another preferred embodiment, the above method further comprises the steps of d) spirally unwinding the wrapped mass of cold-flowable material and e) removing the mass of material from the liner.

In another preferred embodiment, the above method further includes the step of d) progressively traversing the spirally wound mass of material as additional spirals are provided.

The present invention also provides an apparatus for wrapping a mass of material in a liner, comprising a) a means for folding a liner, b) a means for introducing a mass of cold-flowable material onto the liner and c) a means for spirally winding the wrapped mass of material about itself. Another aspect of this embodiment further includes a means for progressively traversing the spirally wrapped mass as additional wraps are provided.

Certain terms are used in the description and the claims that, while for the most part are well known, may require some explanation. It should be understood that when referring the material as "cold-flowable" this means that the matieral will exhibit time-dependent non-elastic deformation or strain under an applied load at temperatures below 120° F. (50° C).

BRIEF DESCRIPTION OF THE DRAWINGS

The present invention will be further explained with reference to the appended Figures, wherein like structure is referred to by like numerals throughout the several views, and wherein.

DETAILED DESCRIPTION OF THE INVENTION

The present invention provides a wrapped mass of material. A preferred embodiment of the invention provides a cold-flowable material such as a hot-melt adhesive wrapped in a liner such that the liner is easily removed from the material. The present invention also provides a method and apparatus for wrapping the material with the liner.

The present invention is also useful for difficult to handle materials, such as materials which stick or bond to themselves. The present invention is also useful with materials which are not coherent or strong enough to be drawn through processing or delivery apparatuses themselves, and which are easily transported by drawing the liner which wraps the material. This can include materials in particulate form, powders, and liquids.

Figure 1:
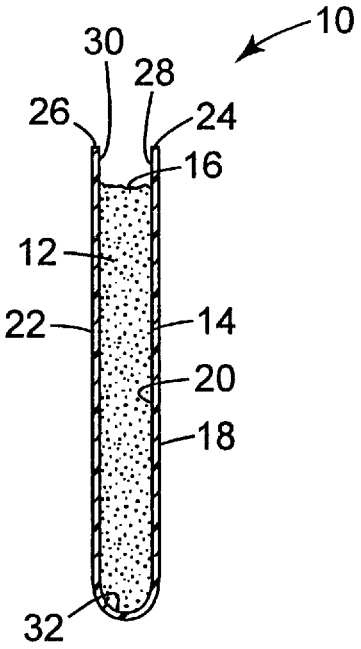
FIG. 1 is a cross-section of a wrapped mass of material partially wrapped with a liner according to a preferred embodiment of the present invention.

FIG. 1 illustrates a mass of material 12 partially wrapped with a liner 18 according to a first preferred embodiment of the present invention. FIG. 1 shows the material in a wrapped state as taken along line 1—1 of FIG. 14. The mass of material 12 has a peripheral surface 14. Liner 18 includes inside surface 20 which contacts the peripheral surface 14 of the material 12. Liner 18 also includes outside surface 22. Liner 18 has a first edge 24 and second edge 26 opposite to one another and extending for the length of the liner 18. Liner 18 is illustrated as having three regions: a first exposed region 28 extending along the length of the liner 18 adjacent first edge 24; a second exposed region 30 extending along the length of the liner 18 adjacent second edge 26; and a center region 32 extending the length of the liner 18 between the first exposed region 28 and second exposed region 30. The liner 18 contacts the peripheral surface 14 of the mass of material 12 at the center region 32 of the inside surface 20 of the liner 18. The exposed portion 16 of the peripheral surface 14 of the mass of material 12 which is not in contact with liner 18 extends between the first and second exposed regions 28, 30 of the liner 18. The exposed surface 16 of material 12 is not in intimate and permanent contact with the inside surface 20 of the liner 18.

Preferably, the first and second edges 24, 26 of the liner 18 are substantially aligned with one another as illustrated, however this is not essential. Preferably the first and second edges 24, 26 of liner 18 extend beyond the exposed surface 16 of the mass of material 12, forming first and second exposed regions 28, 30, as illustrated, however, this is not essential. Exposed surface 16 of the material may instead be flush with the first and second edges 24, 26 of the liner 18.

Figure 2:
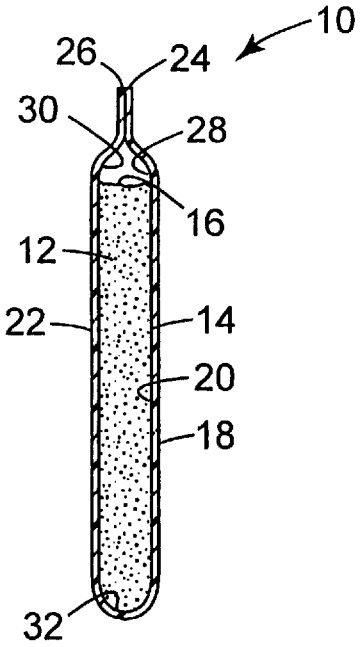
FIG. 2 is a cross-section of a wrapped mass of material with the liner bonded, enclosing the mass of material therein according to a preferred embodiment of the present invention.

In a preferred embodiment of the present invention, the first and second exposed regions 28, 30 of the liner 18 are unbonded to one another along the inside surface 20 of the liner 18. When referring to the first and second exposed regions of the liner as being "unbonded," this means that the first and second exposed regions may or may not contact one another, and, if in contact, are freely separable from one another and have not been bonded to one another such as by an adhesive, heat sealing, ultrasonic welding, or the like. Keeping the liner 18 unbonded facilitates wrapping and unwrapping the material as explained in greater detail below. It is also within the scope of the present invention to bond the first and second regions 28, 30 of the liner to one another to enclose the mass of material 12 therein, as illustrated in FIG. 2. The first exposed region 28 and second exposed region 30 of the liner 18 are bonded. Such bonding may be by means of an adhesive, heat sealing, ultrasonic welding, mechanical means, or the like, and can be chosen based on the material of the liner 18 and the desired strength of the bond. It may be desirable to bond the first exposed region 28 and second exposed region 30 of liner 18 to prevent the material form being exposed to dirt, air, dust, or other contaminants.

All or much of the entire peripheral surface 14 of the material 12 is in contact with the liner 18. In the preferred embodiment, the mass of material 12 has an elongated cross-section. However, any cross-sectional shapes of material 12 can be advantageously wrapped with liner 18 in accordance with the present invention. For example, the cross section of material 12 can be circular, oval, rectangle, oblong, tear-drop shaped, or polygonal with either rounded corners or more sharply defined corners. Typically, material 12 is flowable material and its cross sectional shape will conform to adjacent spirals and the supporting surface of pallet 34.

Figure 3:
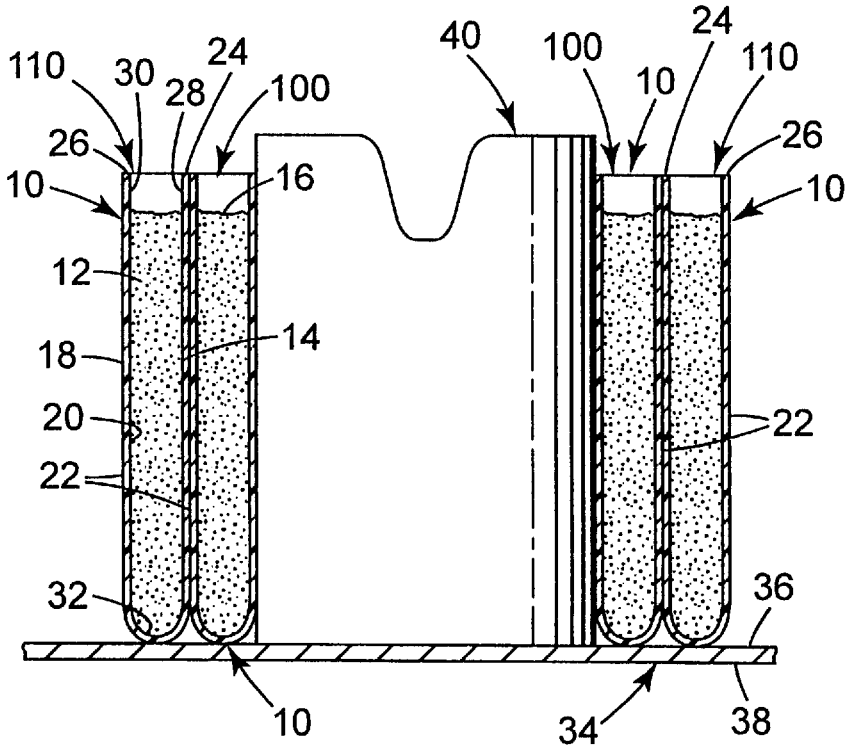
FIG. 3 is a partial cross-section of the wrapped mass of material shown in FIG. 1 spirally wound about a core and supported by a pallet.

The wrapped mass of material 10 is preferably extremely long in the spiral wrap direction relative to any cross-sectional dimension of the material 12. This allows for convenient handling of large amounts of the material 12 by spirally winding a length of the wrapped mass of material about a core assembly 40, as illustrated in FIG. 3. For example, the length can be on the order of 50 or 100 times or more the longest cross-sectional dimension. Additionally, the height of the wrapped material 10 can be in excess of 200 times the cross-sectional width of the material 12, and is preferably in excess of 6 times the width of the material 12. Preferably, the mass of material has a height of 10 inches (25.4 cm) and a width of 1.5 inches (3.8 cm). It is understood that the present invention is not thereby limited, and that smaller and larger length ratios and height to width ratios are within the scope of the present invention.

Figure 10:
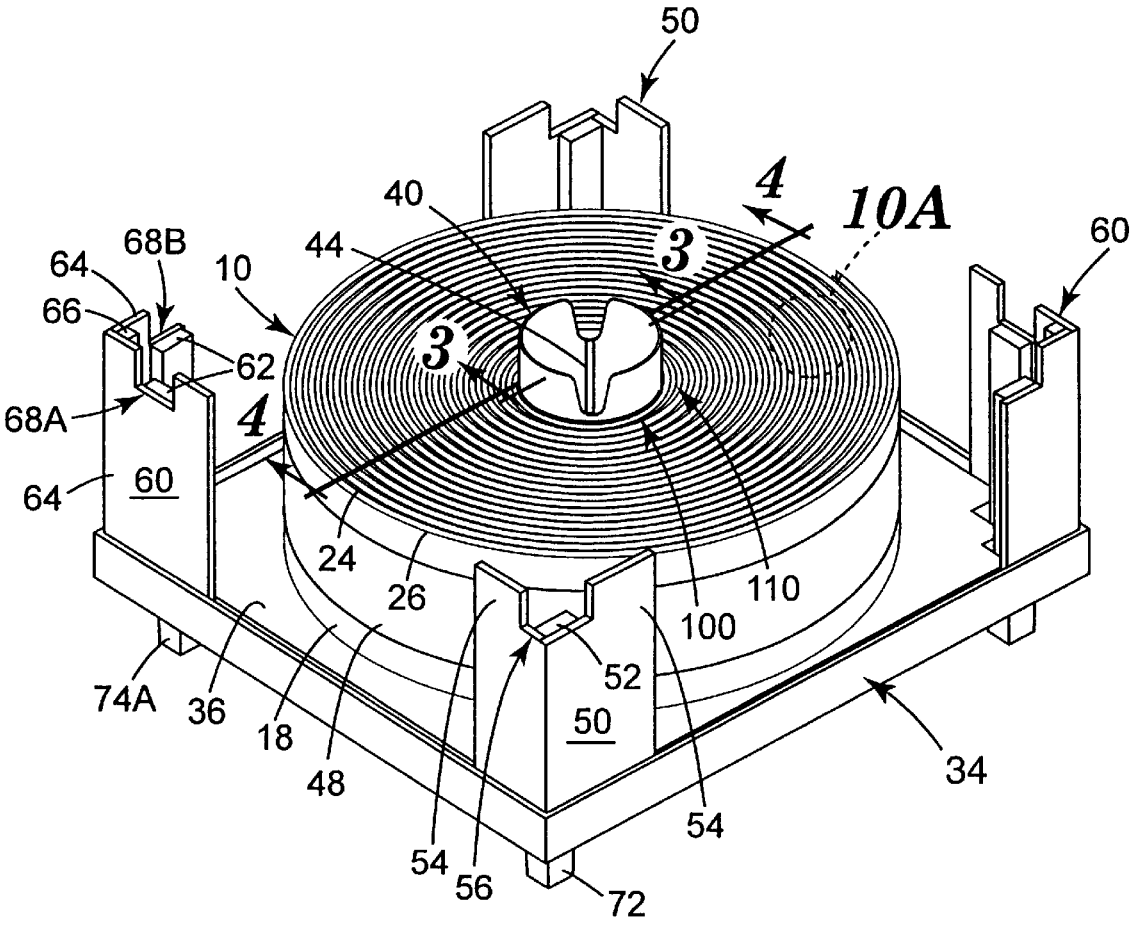
FIG. 10 is an isometric view of a preferred embodiment of the wrapped material, pallet, corner spacers and core.

FIG. 3 shows the spirally wound wrapped mass of material 10 taken along line 3—3 of FIG. 10. The wrapped material 10 is arranged in spirals about the core assembly 40 and is supported by a pallet 34. Pallet 34 includes a first major surface 36 and a second major surface 38 opposite the first major surface 36. The first major surface of the pallet 34 supports the wrapped material 10. Core assembly 40 engages with the first major surface 36 in the general center of pallet 34.

The wrapped mass of material 10 is first wound around the core assembly 40. Then the wrapped mass of material 10 is spirally wound about itself. As seen in FIG. 3, the wrapped material 10 is arranged in spirals about the core assembly 40 such that a first spiral 100 of the wrapped mass of material 10 is adjacent to a second spiral 110 of the wrapped mass of material. Such an arrangement allows the successive spirals to support one another, so as to maintain the mass of material 12 wrapped by the liner 18. Successive spirals of the wrapped material are likewise arranged so that the outside liner surface 22 of each successive spiral contacts the outside liner surface 22 of each respective preceding spiral and so on.

Figure 4:
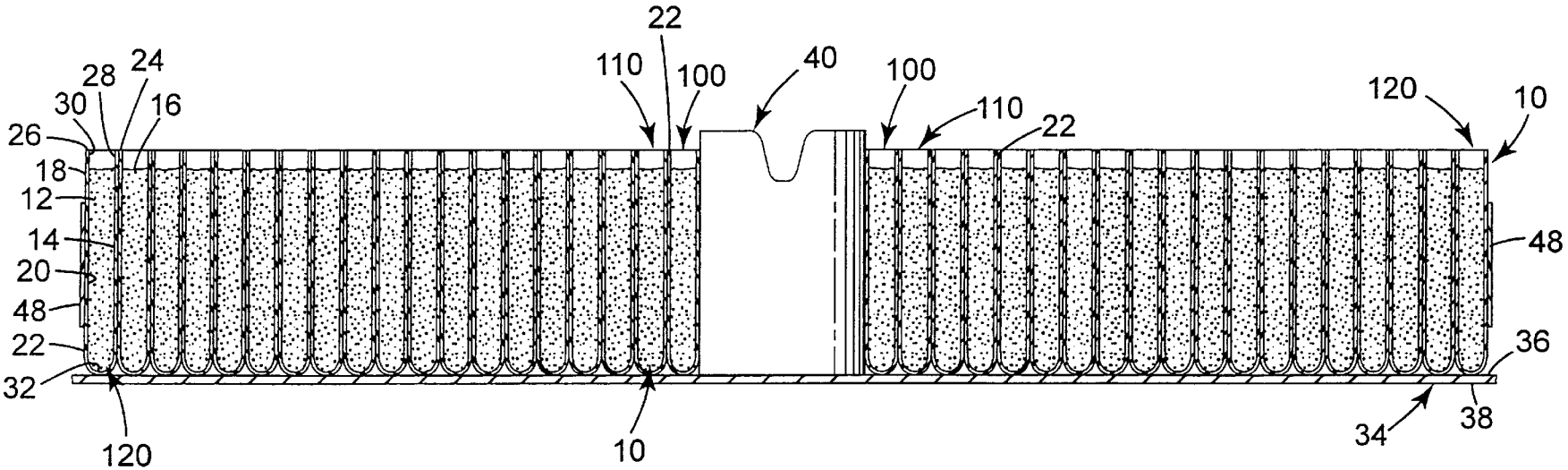
FIG. 4 is a view like FIG. 3, including additional spirals of the wrapped mass of material.

FIG. 4 shows a finished spirally wound wrapped mass of material 10 taken along line 4—4 of FIG. 10. Outside wrap 48 is wrapped in tension around the outer most spiral 120 of wrapped material 10 to support the wrapped material 10. Outside wrap 48 may comprise tape, paper, film, cardboard, liner or any material with sufficient tensile strength, preferably at least of ten lbs./in. More preferably, outside wrap 48 comprises polyester or glass filament adhesive tape. The outside wrap 48 may only need to attach the end of the outermost spiral 120 to the previous spiral and may not need to be wrapped entirely around the outermost spiral 120. The outer most spiral 120 is supported by the outside wrap 48 and the preceding spiral of wrapped material 10. Each internal spiral of wrapped material 10 is supported on either side by the preceding spiral and the subsequent spiral of the wrapped material 10. The pressure between the preceding spiral and the subsequent spiral of wrapped material 10 maintains the mass of material 12 wrapped by the liner 18. In each of the just-described arrangements, the forces acting on the mass of material 12 are at equilibrium, such that there are no unbalanced forces causing the mass of material 12 to be forced out of the liner 18. The liner 18 can be considered to be acting as a trough to hold material 12.

FIGS. 3 and 4 illustrate the wrapped material spirally wound about core assembly 40 supported by pallet 34. Alternatively, the wrapped material 10 could be spirally wound about itself without a core assembly 40. Furthermore, the wrapped material does not require a pallet 34 for support, but is convenient for storage and transportation of the material.

Figure 5:
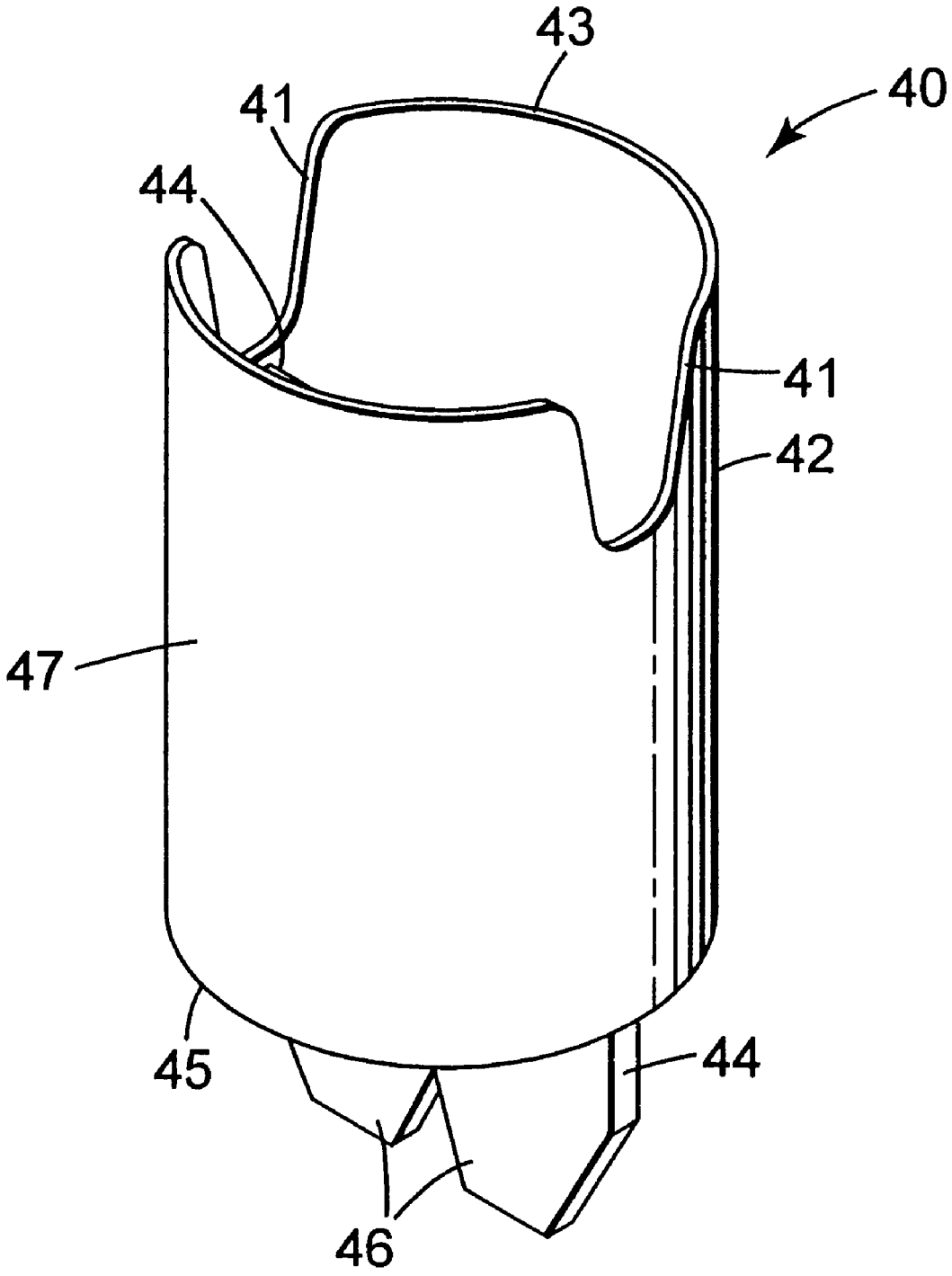
FIG. 5 is an isometric view of a preferred embodiment of a core for use with the present invention.

FIG. 5 illustrates a preferred embodiment of the core assembly 40. Core assembly 40 is configured to engage with a pallet 34. Core assembly 40 includes a core 47 having a peripheral surface 42 and a core center 44. Core 47 includes a first end 43 and a second end 45 opposite the first end 43. Core 47 includes two notches 41 in the first end 43. The two notches 41 are located opposite each other. The core center 44 is located inside core 47, extending across the interior of the core 47. Core center 44 includes two core legs 46 extending from the second end 45 of the core 47. Core legs 46 are configured to engage with first major surface 36 of pallet 34, as shown in greater detail in FIG. 11. Notches 41 are configured to receive the second major surface 38 of a second pallet 34 stacked on top of the first pallet 34.

Figure 6:
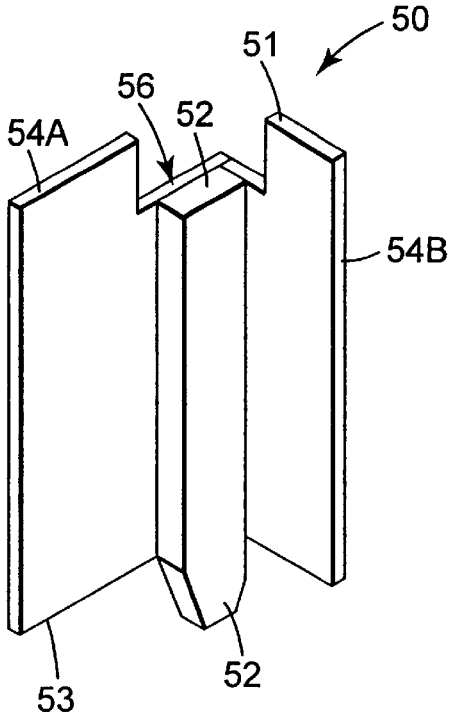
FIG. 6 is an isometric view a preferred embodiment of a first corner spacer.
Figure 7:
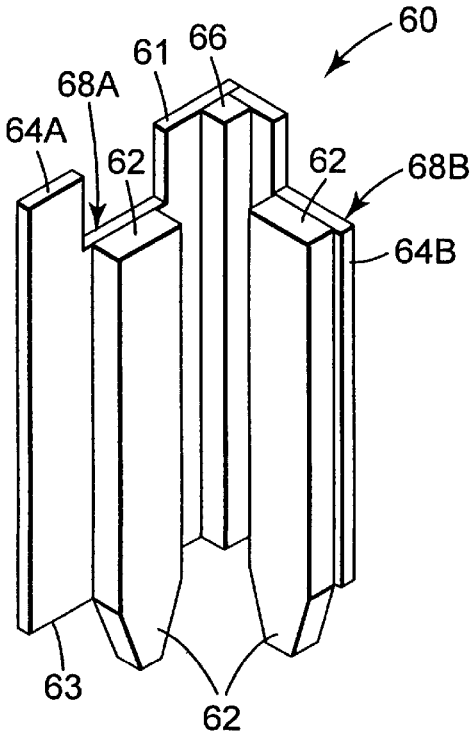
FIG. 7 is an isometric view a preferred embodiment of a second corner spacer.
Figure 11:
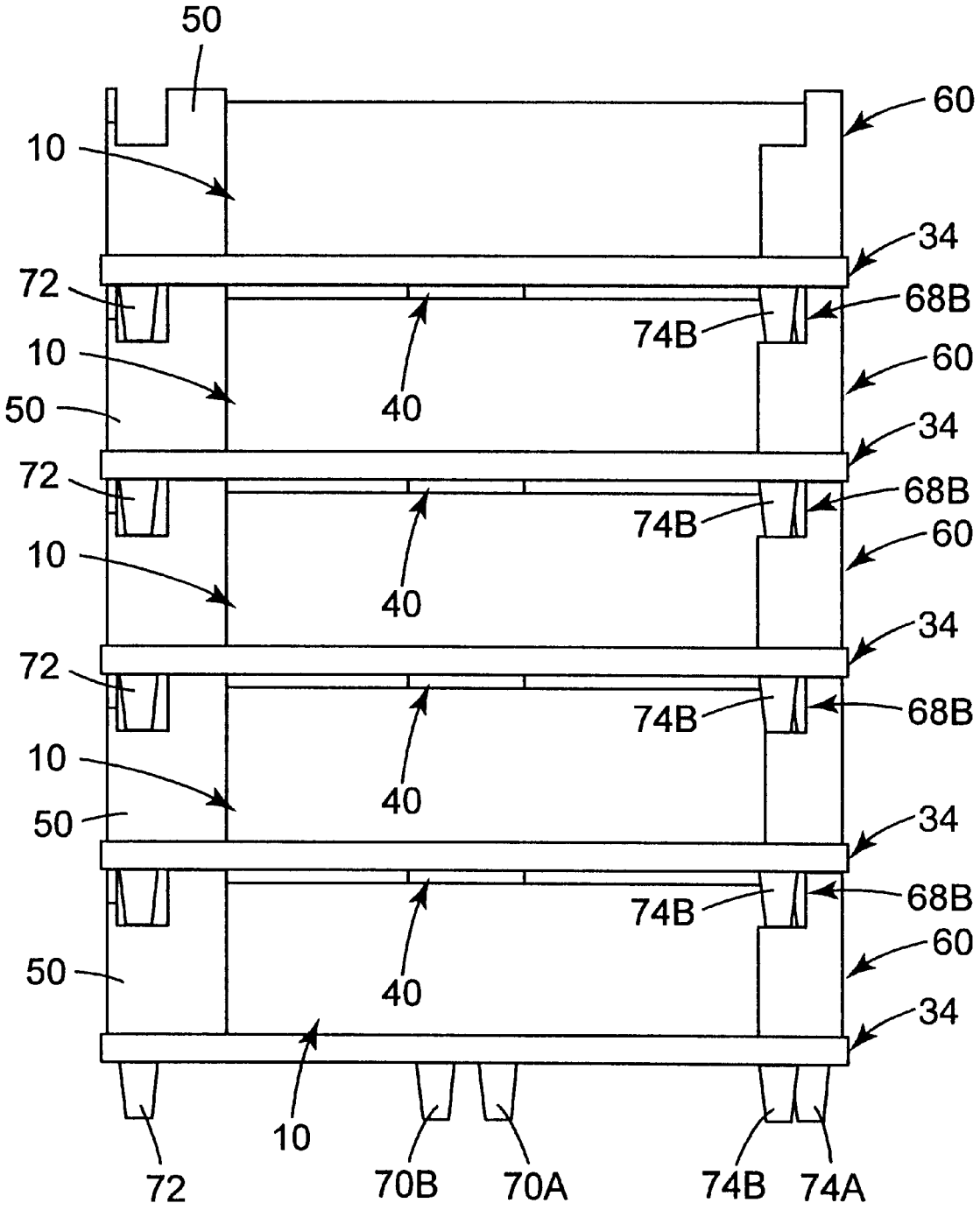
FIG. 11 is a side view of a stack of multiple wrapped masses of material.

FIGS. 6 and 7 illustrate a preferred first corner spacer 50 and a preferred second corner spacer 60, respectively. First spacer 50 and second spacer 60 are configured to engage with the first major surface 36 of a first pallet 34 and to support the second major surface 38 of a second pallet 34 stacked on top of the spacers 50, 60. First spacer 50 and second spacer 60 are mounted in the pallet 34 in adjacent corners, as illustrated in FIG. 10. Spacers 50 are mounted in pallet 34 diagonally opposite one another. Spacers 60 are also mounted in pallet 34 diagonally opposite one another. Several pallets 34 of wrapped material 10 may be stacked sequentially on top of one another using spacers 50, 60, as illustrated in FIG. 11.

First corner spacer 50 includes two walls 54A, 54B assembled 90° relative to each other. First corner spacer 50 includes a first end 51 and a second end 53 opposite the first end 51. A notch 56 is located at the first end 51 of the spacer 50 where the two walls 54A, 54B meet. A corner leg 52 extends along both walls 54A, 54B at the 90° juncture and extends beyond the second end 53 opposite the notch 56. First corner spacer 50 is configured to engage with pallet 34 by placing leg 52 into the corresponding cup 72 in the first major surface 36 of pallet 34, ;s shown in greater detail in FIG. 11. The notch 56 receives the bottom of a cup 72 extending from the second major surface 38 of a second pallet 34. Walls 54A, 54B are configured to engage at their second end 53 with groove 39 located around the periphery of the first major surface 36 of pallet 34. Walls 54A, 54B are configured to support at their first end 61 the second major surface 38 of a second pallet 34.

Second corner spacer 60 includes two walls 64A, 64B assembled 90° relative to each other. Second corner spacer 60 includes a first end 61 and a second end 63 opposite the first end 61. A notch 68A is located in the general middle of the first wall 64A in the first end 61 of spacer 60. Another notch 68B is located on the edge of the second wall 64B in the first end of spacer 60 and is open to the edge of the second wall 64B opposite from the 90° juncture. A support member 66 is located at the 90° juncture of the walls 64A, 64B. A leg 62 extends along the first wall 64A and extends beyond the second end 63 of spacer 60 opposite the notch 68A. Another leg 62 extends along the second wall 64B and extends beyond the second end 63 of spacer 60 opposite the notch 68B. Second corner spacer 60 is configured to engage with the pallet 34 by placing legs 62 into the corresponding cups 74A, 74B in the first major surface 36 of pallet 34, as shown in greater detail in FIG. 11. The notches 68A, 68B support the bottom of cups 74A, 74B extending from the second major surface 38 of a second pallet 34. Walls 64A, 64B are configured to engage at their second ends 63 with groove 39 located around the periphery of the first major surface 36 of pallet 34. Walls 64A, 64B are configured to support at their first end 61 the second major surface 38 of a second pallet 34.

Figure 8:
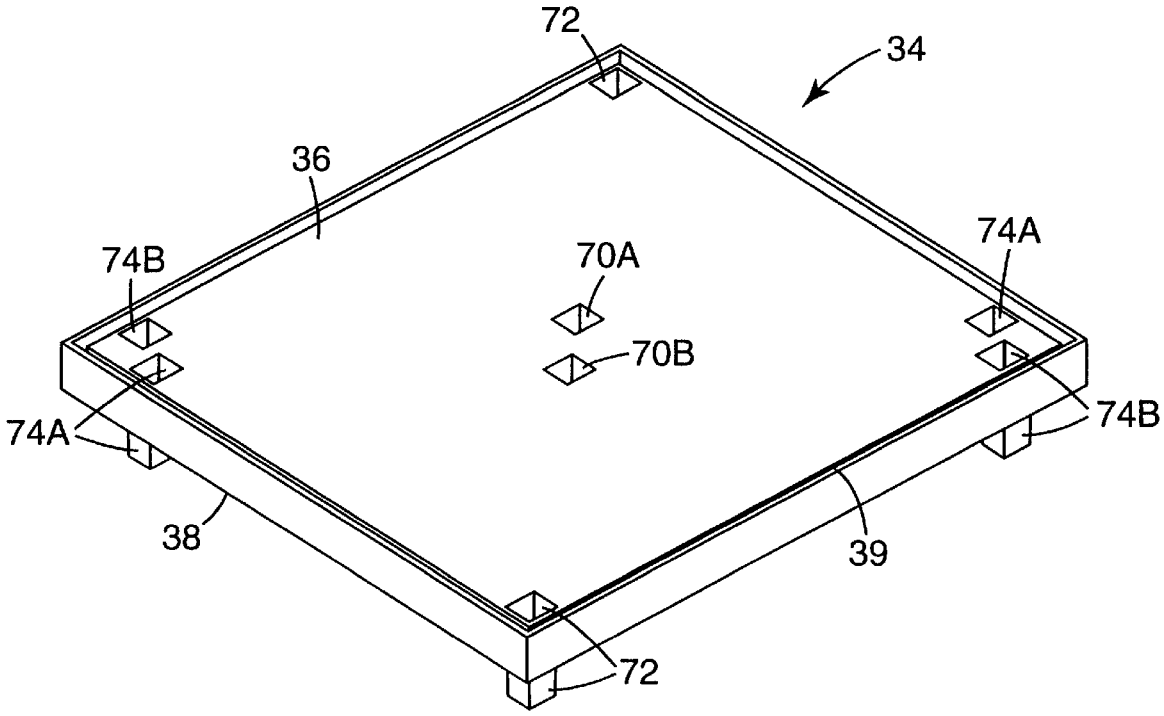
FIG. 8 is an isometric view of a preferred embodiment of a pallet for use with the present invention.
Figure 9:
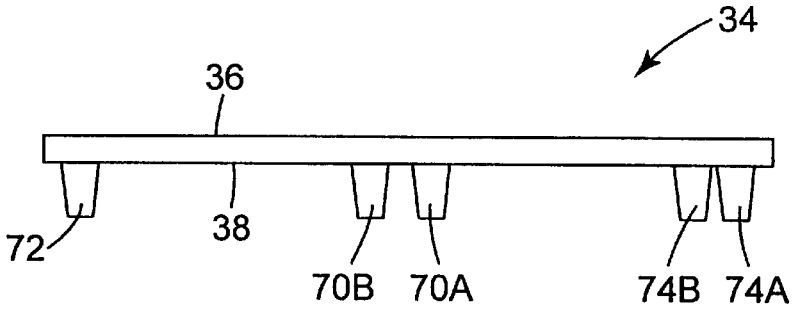
FIG. 9 is a side view of a preferred embodiment of the pallet of FIG. 8.

FIG. 8 and FIG. 9 illustrate a preferred embodiment of pallet 34. FIG. 8 is an isometric view of pallet 34. FIG. 9 is a side view of pallet 34. Pallet 34 has a first major surface 36 and a second major surface 38 opposite first major surface. Around the periphery of the first major surface 36 is groove 39. Core cups 70A and 70B are located near the middle of the first major surface 36 of pallet 34. Core cups 70A, 70B are configured to engage with the legs 46 of core assembly 40. Spacer cups 72 and spacer cups 74A, 74B are located in opposite corners of pallet 34. Spacer cup 72 is configured to engage with the leg 52 of the first corner spacer 50. Spacer cups 74A, 74B are configured to engage with legs 62 of the second corner spacer 60. Cups 70A, 70B, 72, 74A, 74B also extend from the second major surface 38 of pallet 34, as shown in FIG. 9, for engagement with the notches 41 in the first end 43 of the core 47, notches 56 in the first end 51 of first spacer 50, and notches 68A, 68B in the first end 61 of second spacer 60 of the stacked pallet 34 below.

FIG. 10 is an isometric view of a wrapped mass of material 10 supported by a pallet 34 with first corner spacers 50 and second corner spacers 60. Walls 54A, 54B of first corner spacer 50 engage with groove 39 located around the periphery of the first major surface 36 of pallet 34. Legs 52 of first corner spacers 50 engage with cups 72. Legs 62 of second corner spacers 60 engage with cups 74A, 74B. Walls 64 of second corner spacer 60 also engage with groove 39 located around the periphery of the first major surface 36 of pallet 34.

As illustrated in FIG. 10, the first edge 24 and second edge 26 of the liner 18 are unbonded. The material 12 inside the liner 18 of one spiral of wrapped material 10 is sufficiently supported on both sides of liner 18 by adjacent spirals of wrapped material 10 to attenuate the material 12 from being forced out of the liner 18. This is especially advantageous when the material 12 is a cold-flowable material. Thus, the present invention maintains the cold flowable material 12 in the liner 18, while allowing the liner to be easily and conveniently removed from the material 12 as discussed below. This provides the advantage of avoiding complex, time consuming, and expensive methods and apparatus for removing the liner from the material. It also allows for convenient re-use of the liner 18 because it is not damaged upon removal from the material 12. It also allows selection of any desired liner material that provides the desired release characteristics for the particular material 12 to be wrapped, without concern for consuming the liner 18 when using a hot-melt pressure sensitive adhesive as the material 12, which previously required using a liner material compatible with the pressure sensitive adhesive. Alternatively, suitable liners may be used which are meltable and mixable with the hot melt adhesive so as to provide a coatable hot melt adhesive composition.

Liners 18 useful in the present invention include woven and nonwoven fabrics, polymeric films, flexible papers, and the like which may be optionally coated or treated with a release material to modify at least the inside surface 20 of the liner 18, and optionally the outside surface 22 of the liner 18. Examples of specific materials which are suitable for liner 18 include silicone-coated fabrics, silicone-coated biaxially oriented polyester films, TEFLON films or fabrics, biaxially oriented polypropylene films, polyethylene films, and polyethylene coated fabrics or papers. The release coating, if any, on the liner 18 is selected generally to obtain desired release characteristics from the particular material 12. For example, a silicone release surface is preferable when material 12 is an acrylate pressure sensitive adhesive, while a TEFLON release surface may be preferable when material 12 is a silicone pressure sensitive adhesive.

It is understood that relatively small amounts of the material 12 may be forced out of the liner 18, depending on the material rheology, liner configuration, spiral configuration, winding tension, temperature of material 12 and other factors, and that the material will nonetheless be considered a "wrapped mass of material" as that term is used herein, including the claims. It is therefore preferred that the liner 18 have suitable release characteristics on both its inside surface 20 and outside surface 22, such as a silicon release coating.

Figure 10A:
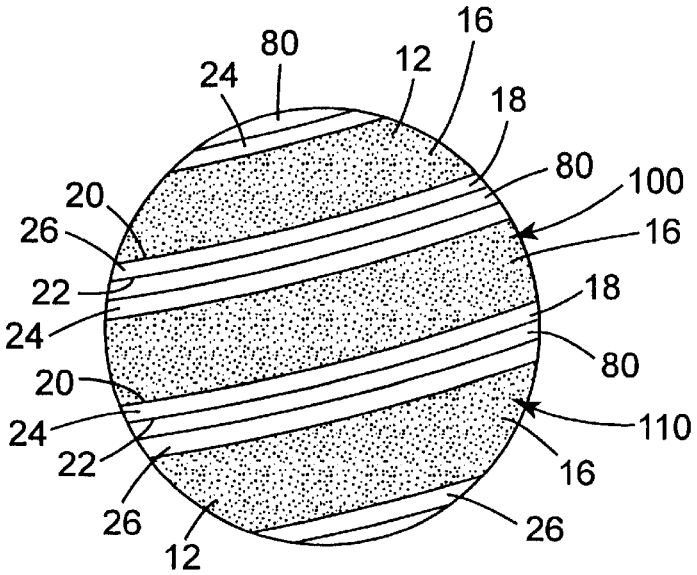
FIG. 10A is an exploded view of the spirals of wrapped mass of material with an optional reinforcing film interposed between consecutive spirals.

FIG. 10A illustrates an alternative embodiment of wrapped mass of material 10. As illustrated in FIG. 10A, an optional reinforcing film 80 may be interposed between sequential spirals, for example, between a first spiral 100 and a second spiral 110. The reinforcing film 80 is wound with the wrapped material 10 as it is spirally wound about itself. The reinforcing film 80 provides additional support to the wrapped material 10.

Figure 10B:
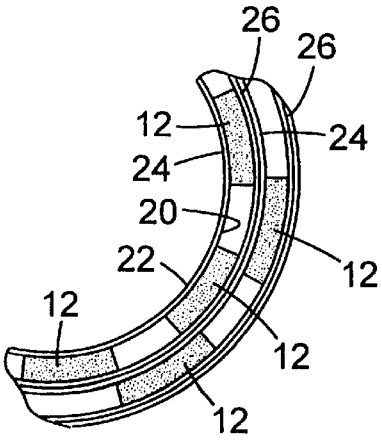
FIG. 10B is an exploded view of an alternative embodiment of the spirals of wrapped mass of material.

The wrapped mass of material 10 shown in FIGS. 1–4, and FIG. 10 is illustrated as including a continuous mass of material 12 and a continuous liner 18. Alternatively, any number of discrete pieces of material 12 may be interspersed throughout liner 18, as illustrated in FIG. 10B. Furthermore, liner 18 may include any number of discrete lengths of liner 18. Also, a first spiral 100 of wrapped mass of material 10 may be discontinuous from a second spiral 110 of wrapped mass of material 10.

Any desired number of spirals of wrapped material 10 may be wound around the core assembly 40, as determined by the cross sectional width of the wrapped mass of material 10, the diameter of the core 47, and the area of the first major surface 36 of pallet 34. Preferably, the width of exposed surface 16 of material 12 is approximately 1.5 inches (3.8 cm). Preferably the height of the material 12 is 10 inches (25.4 cm). Preferably, 5 to 6 pounds (2.3–2.7 kg) of material 12 are wrapped by a 1 ft (30.5 cm) length of liner 18 in the spiral direction. Preferable dimensions of pallet 34 are 3.75 ft by 4 ft (1.14 m by 1.22 m). A pallet of this size can hold 75–80 ft of liner 18 (22.8–24.3 m), containing approximately 450 lbs (205 kg) of adhesive.

FIG. 11 illustrates multiple pallets 34 of wrapped material 10 stacked vertically, one on top of the other. Core assembly 40, first corner spacers 50 and second corner spacers 60 support the pallet 34 above them. The notches 41 located in the first end 43 of core 47, the notches 56 in the first end 51 of first spacer 50, and the notches 68A, 68B in the first end 61 of second spacer 60 are configured to receive the corresponding cups 70A, 70B, 72, 74A, 74B of pallet 34 located directly above core assembly 40 and spacers 50, 60. Walls 54A, 54B of first corner spacer 50 at their second end 53 engage with groove 39 located around the periphery of the first major surface 36 of a first pallet 34 below and engage at their first end 51 with groove 39 located around the periphery of the second surface 38 of a second pallet 34 above, providing lateral support for both first and second pallets 34. Walls 64 of second corner spacer 60 at their second end 63 engage with groove 39 located around the periphery of the first major surface 36 of a first pallet 34 below and support at their first end 61 the second surface 38 of a second pallet 34 above, providing lateral support for both first and second pallets 34.

Material 12 can comprise any material which can be held in liner 18. The present invention is particularly well suited for use with materials that are cold flowable at room temperature (about 20° C.), or materials that tend to stick to themselves at room temperature to form a large mass of material that may be difficult to handle. Such materials include A-B-A and A-B elastomeric block copolymers (such as styrene-butadiene copolymers, styrene-isoprene-styrene-block copolymers, and acylonitrile copolymers), pressure-sensitive adhesives (including those made from acrylates, ethylene-vinyl acetate, and tackified and/or plasticized block copolymers), thermosettable materials (such as epoxy resins), and the like. Block copolymers are commercially available from Shell Chemical Co. under the Kraton™ tradename. The present invention is also particularly well suited for use with pressure sensitive adhesives and hot melt adhesives. Pressure sensitive adhesives are adhesives which are tacky at room temperature and generally have a glass transition temperature below 0° C. Hot melt adhesives are generally non-tacky or slightly tacky at room temperature, but become significantly tacky at elevated temperatures. The present invention is particularly well suited for use with adhesives, and other materials, which are cold-flowable materials, and particularly with materials which are cold-flowable at room temperature (20° C).

Examples of adhesives which can be wrapped by the present invention include acrylate adhesives, such as those described in U.S. Pat. No. Re. 24,906 (Ulrich); U.S. Pat. Nos. 4,833,179; 4,952,650; 5,292,844; 5,374,698; 5,464,916; and co-pending U.S. patent application Ser. No. 08/919,756 (Hamer et al); polyalpha-olefin adhesives; and ethylene vinyl acetate adhesives.

The present invention is also useful for adhesives that may not exhibit cold flow, but are tacky or otherwise have a tendency to stick to themselves making handling difficult. Such adhesives include copolymer adhesives such as styrene-isoprene-styrene copolymers, styrene-butadiene copolymers, acrylonitrile rubber copolymers and the like. The copolymers are typically tackified and/or plasticized to make them pressure sensitive. The present invention is also useful with materials which are not coherent or strong enough to be drawn through processing or delivery apparatuses themselves, and which are easily transported by drawing the liner which wraps the material. This can include materials in particulate form. The present invention is also useful with materials such as resins.

The present invention is also useful to package materials that are liquids at elevated temperatures and are solids at room temperature. This allows wrapping of material 12 while it is liquid and then cooling to a solid.

Figure 12:
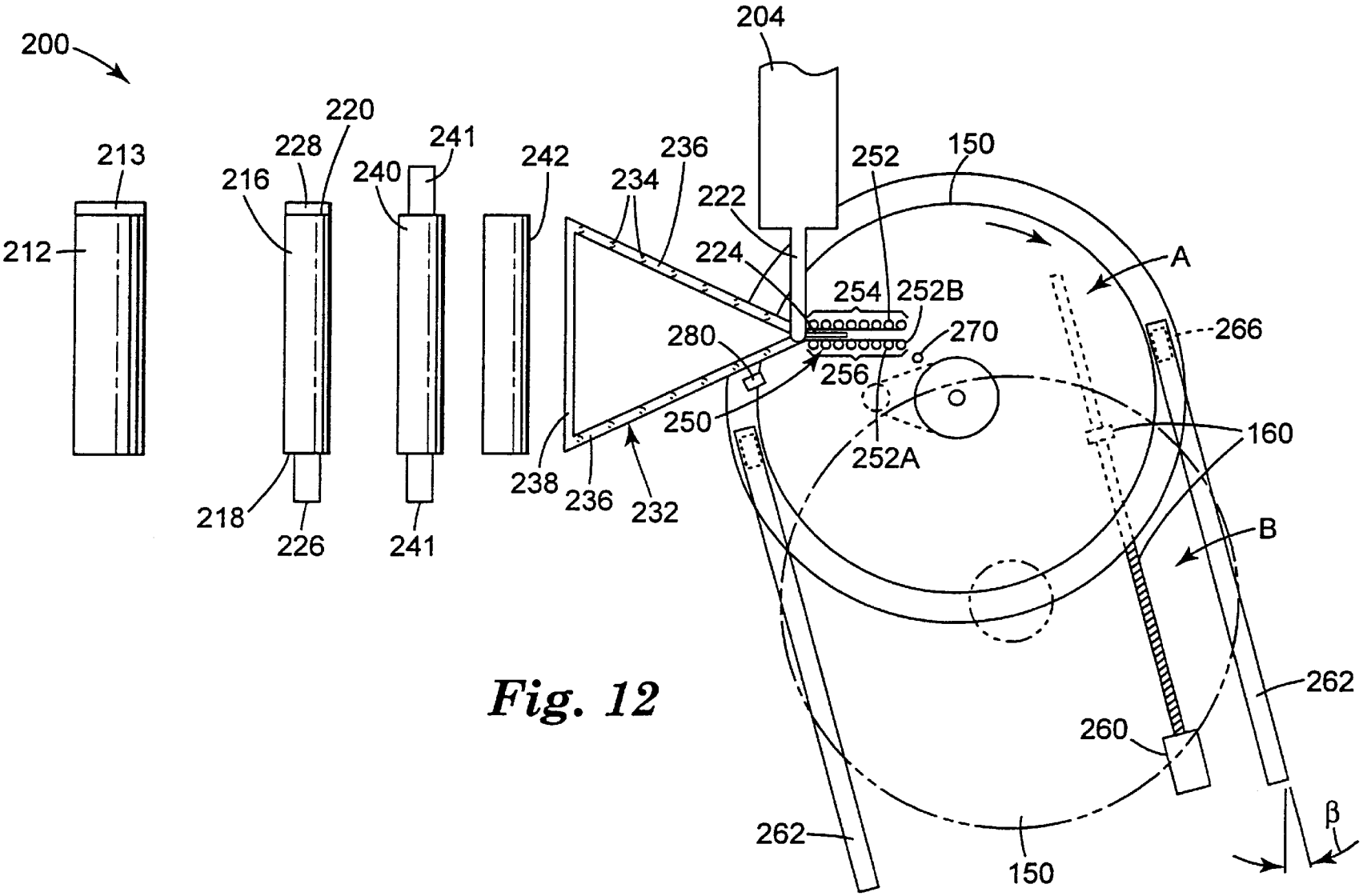
FIG. 12 is a partially schematic top view of an apparatus and method for wrapping a mass of material with a liner according to the present invention.
Figure 13:
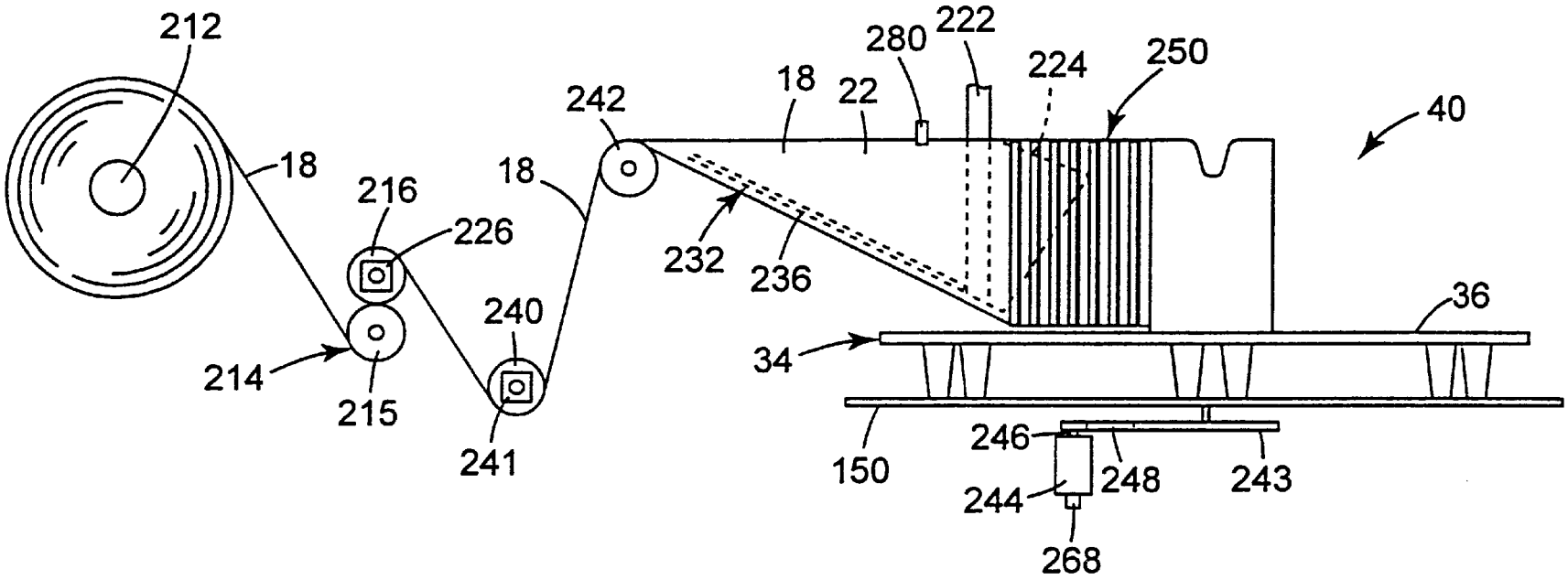
FIG. 13 is a side view of the apparatus of FIG. 12.
Figure 14:
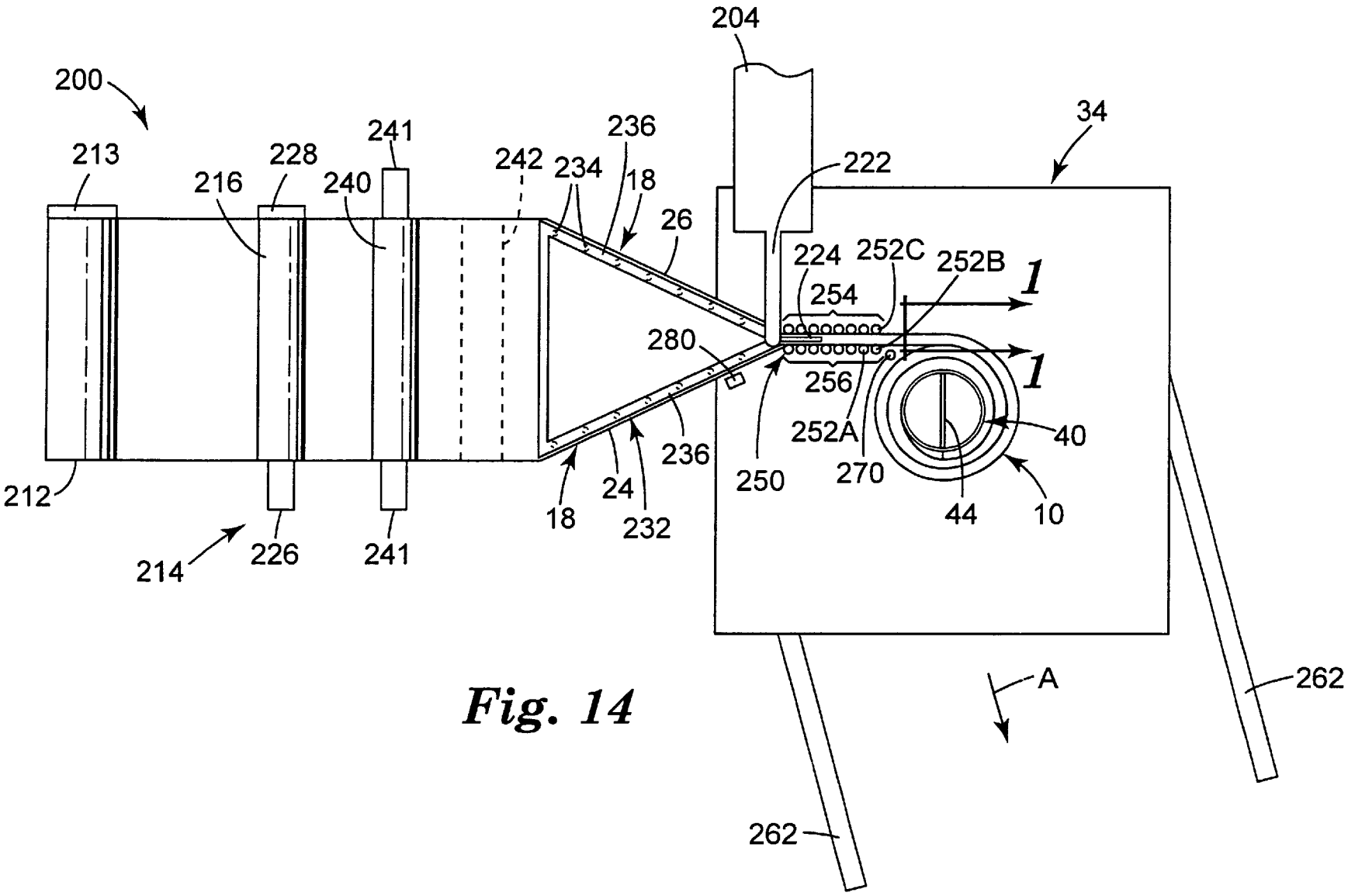
FIG. 14 is a view like FIG. 12 with a spiral wound mass of material.

FIGS. 12–14 are a schematic views of a wrapping apparatus 200 and method for wrapping a mass of material 12 with a liner 18 according to the present invention. FIG. 12 is a top view of wrapping apparatus 200. FIG. 13 is a side view of a wrapping apparatus 200 and liner 18. FIG. 14 is a top view of the wrapping apparatus 200 with a wrapped mass of material 10 spirally wound about a core assembly 40.

As illustrated in FIG. 13, a length of liner 18 is initially provided in roll form at liner spindle 212. Liner spindle 212 has a brake 213. Brake 213 is set at a constant setting to inhibit spindle 212 from freely rotating, but instead to rotate with a slight amount of resistance. The liner 18 progresses from the liner spindle 212 to the nip assembly 214. Nip assembly 214 includes roller 215, roller 210, encoder 226 and brake 228. Roller 215 is preferably covered in rubber. Roller 216 has a first end 218 and a second end 220 opposite the first end 218. Encoder 226 is attached to a first end 218 of roller 216. Encoder 226 is any suitable device for measuring the rotational speed of roller 216 to determine the linear speed of the liner 18. As illustrated, brake 228 is attached to the second end 220 of roller 216 and controls tension in liner 18. It may be preferable to mount brake 228 and encoder 226 on separate rollers. Nip assembly 214 also prevents the liner 18 from slipping, which is desired so encoder 226 provides an accurate liner speed.

After the liner 18 passes through the nip assembly 214, it passes over tension roller 240 and over feed roller 242. Tension roller 240 has transducers 241 mounted on each end. The transducer 241 is any suitable device for measuring the tension on the liner 18 as it passes around the tension roller 240. Up until this point, the liner 18 is in a generally planer, unfolded state.

After the liner 18 passes over feed roller 242, the liner is introduced to the folding assembly 232. Folding assembly folds liner 18 approximately in half before the mass of material 12 is introduced into the fold. Folding assembly 232 includes two V-bars 236 and a cross bar 238, forming a triangle. Cross bar 238 is parallel with the axis of feed roller 242 and provides support to both V-bars 236. V-bars 236 are tilted downward in the direction from feed roller 242 and are attached for support to a supply pipe 222. The liner 18 first passes under cross bar 238. The first edge 24 and second edge 26 of liner 18 remain relatively aligned as the V bars 236 introduce a fold into the liner 18. V bars 236 include air holes 234 running the length of the V bars 236. The air holes 234 blow air against the liner as the liner 18 passes against the bars 236 thereby reducing friction between the liner 18 and the V bars 236 as the liner 18 is pulled into guide roll assembly 250.

Figure 16:
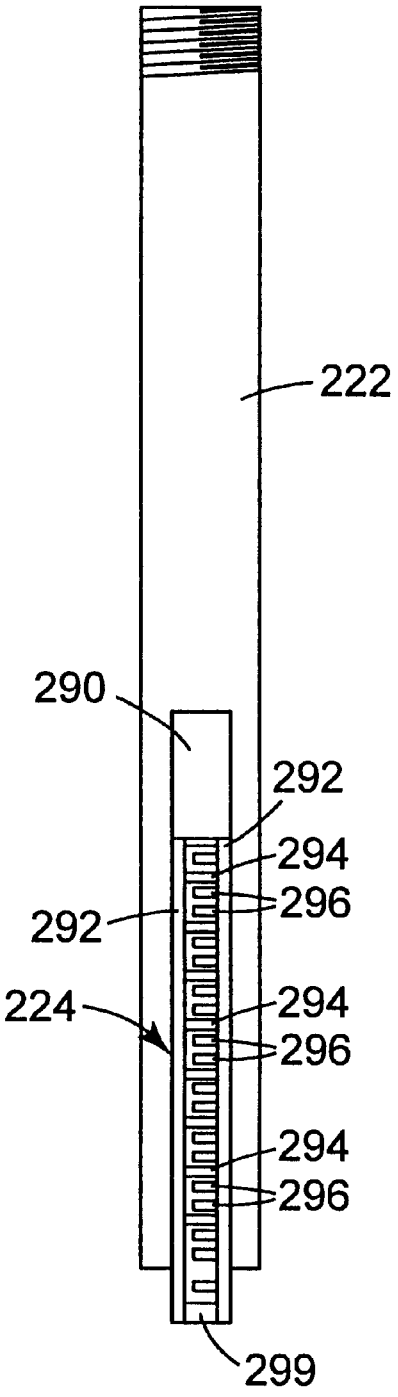
FIG. 16 is a front view of the supply tube and exit nozzle of FIG. 15.
Figure 15:
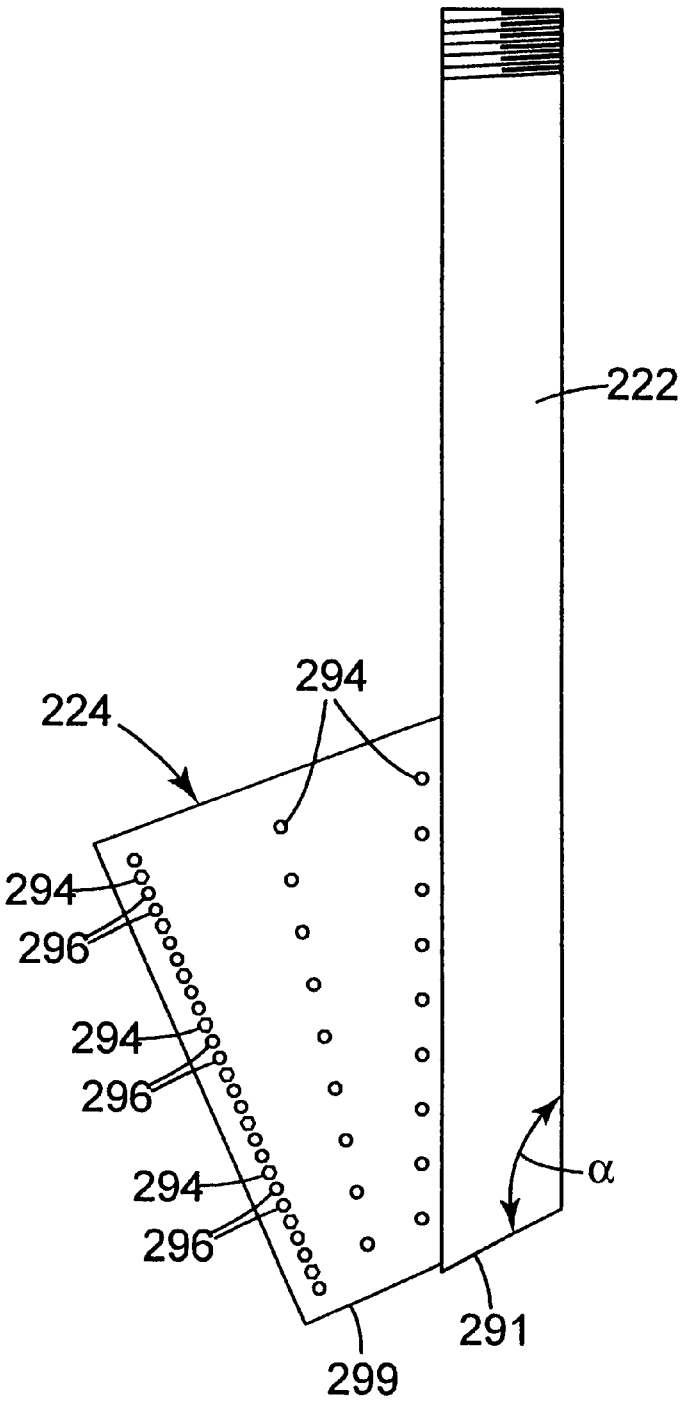
FIG. 15 is a side view of a preferred embodiment of supply tube and exit nozzle.

In the illustrated embodiment, the mass of material 12 is a cold-flowable material, such as a hot-melt pressure sensitive adhesive. The material 12 flows from an extruder 204 into supply tube 222 and through exit nozzle 224, as is commonly known to those of ordinary skill in the art of handling hot-melt or cold flowable materials. The mass of material 12 is introduced onto the inside surface 26 of the liner at the center region 34 of the liner by nozzle 224. Nozzle 224 may be one continues nozzle or a series of nozzles. A preferred embodiment of nozzle 224 is illustrated in FIGS. 15–16. It is preferable to position the exit nozzle 224 to introduce the material 12 at a height below the first and second edges 24, 26 of the liner 18. Material 12 can be prepared (polymerized, blended, or compounded, for example, as appropriate for the particular material) at a time or location remote from the wrapping apparatus 200, and then delivered into the wrapping apparatus 200. Alternatively, the material 12 can be prepared and then introduced into wrapping apparatus 200 in a continuous process. Furthermore, it is understood that extruding the material 12 through supply tube 222 and exit nozzle 224 is just one of many ways to introduce the material into the liner 18. The material 12 can be introduced onto the liner 18 by any external conveyer. For example, material 12 can be extruded in a film or sheet form, and then repeatedly folded or wrapped upon itself to obtain a generally elongated cross section and then introduced into the liner 18.

As material 12 is introduced into liner 18, the liner is pulled through the guide roll assembly 250. Guide roll assembly provides a place to load the material 12 into the liner fold and guides the wrapped mass of material 10 to the pallet 34. Guide roll assembly includes a first row 254 of eight vertical rollers 252 and a second row 256 of eight vertical rollers 252. The first row 254 of rollers 252 is hinged on the roller 252C and can pivot away from the second row 256 of rollers 252. This allows an operator to access the exit nozzle 224, easily thread liner 18, inspect nozzle flow or make nozzle adjustments. The second row 256 of rollers 252 is stationary. All eight of the rollers 252 in the first row 254 are non-driven. Drive roller 252A and drive roller 252B of the second row 256 are driven. The liner 18 near first edge 24 is pulled by drive roller 252A and drive roller 252B. The section of liner near the first edge 24 will have a tendency to slack because that side of the liner 18 will be at a smaller radius than the opposite side of the wrapped material 10 as it is spirally wound around core assembly 40. Drive rollers 252A and 252B ensure that the liner 18 near first edge 24 will not slack as the wrapped material 10 is spirally wound around core assembly 40 forming spirals of wrapped material 10 adjacent to one another. Preferably, drive rollers 252A, 252B are wrapped with silicone belt material. This provides sufficient friction between the rollers 252A, 252B and the liner 18 as it goes through the guide roll assembly 250. The rotational speed of the drive rollers 252A, 252B is above the linear speed of the liner 18. Preferably, the rotational speed of drive rollers 252A, 252B is 150% of the linear speed of the liner 18.

The wrapped mass of material 10 exits the guide roller assembly and is spirally wound around core assembly 40 mounted in the middle of the first major surface 36 of pallet 34, as described above with respect to FIG. 3. To start spirally winding the wrapped material 10 around core assembly 40, the wrapped material is taped manually to the core assembly 40. As seen in FIGS. 13–14, the pallet 34 is provided on top of driven turntable 150. Turntable 150 rotates the pallet 34 so as to spirally wind the wrapped material 10 about the core assembly 40. Turntable motor 244 rotates the drive sprocket 246 which drives a chain 248 which rotates the turntable sprocket 243 thereby rotating turntable 150. The driven turntable 150 rotates the pallet 34, thereby providing the driving force for pulling the wrapped material 10 through the guide roll assembly 250. The pallet 34 is clamped to turntable 150 during operation and the core assembly 40 is externally clamped to pallet 34 during operation.

A computer or programmable logic controller, referred to herein as a "PLC," uses information received from encoders or other sensors in the apparatus 200 to control various parameters such as speed or operation of motors used to rotate turntable 150 and to move turntable 150 laterally, and to control the tension and speed of the liner 18.

As illustrated in FIG. 14, it is preferred that the wrapped material 10 about to be wound around core assembly 40 be oriented generally tangentially to the already spirally wound material 10 around core assembly 40 so as to reduce or eliminate slack on wrapped material 10. To maintain the wrapped mass 10 exiting the guide roll assembly 250 generally tangent to the wrapped material 10 previously wound around core assembly 40, turntable 150 traverses laterally as the diameter of the already spirally wound wrapped material 10 increases as shown by arrow A. To facilitate this, turntable 150 is mounted on a movable frame which is laterally moved by ball screw 160. (See FIG. 12.) An indexing motor 260 drives the ball screw 160 thereby causing turntable 150 to traverse laterally from position A to position B (shown in phantom lines for clarity), as illustrated in FIG. 12. Wheels 266 mounted on the movable frame roll on track 262 to maintain the direction of turntable 150. Track 262 is orientated at an angle $\beta$ relative to a line perpendicular to the guide roll assembly 250. Preferably, angle $\beta$ is between 11–15°. More preferably, angle $\beta$ is 12°.

As shown schematically in FIGS. 12 and 14, a sensing arm 270 is attached to the guide roller assembly 250 and located between the guide roller assembly 250 and core assembly 40 mounted in the pallet 34. Sensing arm 270 provides feedback to the PLC or computer which in turn controls the operation of the turntable index motor 260. As the diameter of the already wound material 10 on core assembly 40 increases, the material 10 contacts and moves the sensing arm 270 sending a signal to the PLC to start the indexing motor 260 mounted below turntable 150 to drive the turntable 150 away from the sensing arm 270, towards position B. As the turntable 150 moves away from the sensing arm, the wound material 10 comes out of contact with the sensing arm 270 which sends a signal to the PLC to deactivate the index motor 260. This process repeats again when the diameter of the wrapped material 10 on core assembly 40 increases enough to contact the sensing arm 270. This process continues until the turntable 150 and the moveable frame move from position A to position B, as illustrated in FIG. 12. As the index motor 260 turns the ball screw 160, the number of rotations of the ball screw 160 is counted. The number of ball screw rotations are used to calculate the distance the turntable has been traversed, which is used to calculate the diameter of the already wound material 10. At position B, no more wrapped material 10 will be wound around core assembly 40.

A first encoder 268 is mounted on the turntable motor 244 to measure the rotational speed of the turntable 150. It is preferred to keep the liner speed constant during the operation of the apparatus 200. The rotational speed of the turntable 150 therefore will need to decrease as the diameter of the wrapped material 10 around core assembly 40 increases, as described above.

A second encoder 226, mounted on the first end 218 of roller 216, measures the linear speed of liner 18. The computed liner speed, based on the diameter of the already wrapped material 10 mentioned above and rotational speed of the turntable 150, is compared by the PLC to the actual linear speed of the liner 18, which is measured by the second encoder 226 mounted on roller 216. If the actual speed of the liner 18 measured at roller 216 is at least 20% greater than the calculated liner speed at the turntable 150, then the PLC signals the turntable 150 speed to increase. This reduces or eliminates slack in the wrapped material 10 as it is spirally wound about core assembly 40. This greater than 20% differential could occur if material 12 exiting nozzle 224 into guide roller assembly 250 is thick enough to increase the force between the drive guide rollers 252A, 252B and the liner 18 causing the liner 18 to increase its line speed up to the drive guide roller speed of 150% of line speed. When this occurs, the PLC signals the turntable 150 to increase it's rotational speed to accommodate the increased speed of the wrapped material 10 exiting the guide roll assembly 250. With this increased liner speed, the thickness of the material 12 will decrease, thus decreasing the force between the drive rollers 252A, 252B and liner 18.

As seen in FIGS. 12–14, a transducer 241 is mounted on the tension roller 240 for measuring the tension in the liner 18. A brake 228 is mounted on the second end 220 of roller 216. As the liner tension measured by transducer 241 increases or decreases, the PLC will tighten or loosen brake 228 on roll 216 appropriately to maintain a generally constant liner tension. Preferably, liner tension is set at 10 lbs (44 N). Desired liner tension depends on liner strength, desired wrapping tension, and material rheology.

Also seen schematically in FIGS. 12–14, an electric eye 280 is mounted next to the folding assembly 232. When the electric eye senses that liner 18 is not running along the folding assembly 232 or is not at the desired height, it sends a signal the PLC which in turn sends a signal to the extruder 204 and the turntable drive motor 244 to stop. This prevents material 12 from being introduced by the exit nozzle 224 into the guide roller assembly 250 without a liner 18 present or with the liner 18 out of position.

The method for wrapping a mass of material 12 with a liner illustrated in FIGS. 12–14 and described above includes the steps of: a) folding a liner 18; b) introducing a mass of material 12 onto the liner 18; and c) spirally winding the wrapped mass of material 10 about itself. It is understood that the order of step a) and step b) may be interchanged, such that the mass of material 12 may be first introduced onto liner 18 and then the liner 18 may be folded prior to spirally winding the wrapped mass of material.

The method for unwrapping the mass of material 12 includes the steps of a) unwinding the wrapped mass of material 12 and b) removing the liner 18 from the mass of material 12. Alternatively, if the material 12 is a hot melt adhesive and the liner 18 is meltable and mixable with the hot melt adhesive so as to provide a coatable hot melt adhesive composition, the wrapped adhesive may be melted with the liner 18.

An alternative method for unwrapping a wrapped mass is described in copending U.S. application Ser. No. 08/753461, filed on Nov. 25, 1996, the entire disclosure of which is incorporated herein by reference.

FIGS. 15 and 16 illustrate a preferred embodiment of a supply tube 222 and exit nozzle 224. FIG. 15 is a side view of supply tube 222 and exit nozzle 224. FIG. 16 is a front view of supply tube 222 and exit nozzle 224. Supply tube 222 and exit 224 are configured to deliver a uniform volume flow of material 12 into liner 18 throughout the cross-section of material 12. An elongated slot is located in supply tube 222 and extends upward from first end 291. Exit nozzle 2.24 is attached to supply tube 222 at the slot. Exit nozzle 224 includes two side plates 292, top plate 290, and bottom plate 299. The material 12 flows through the opening provided within side plates 292 and top plate 290 and bottom plate 299. Top and bottom plates 290, 299 are generally parallel to each other and are tilted downward at angle $\alpha$. Angle $\alpha$ is preferably 110°–125°, and more preferable 116°. Side plates 292 are generally parallel to one another and are connected by a series of bolts 294, which extend entirely across the opening between the plates 292. The exit nozzle 224 is designed to deliver material 12 from the bottom of fold in the liner 18 to within one to two inches from edges 24 and 26. Plates 292 also include threaded flow control bolts 296 which may be adjusted to varying lengths. The number, position, and lengths of threaded flow control bolts 296 are adjusted to provide a uniform pressure drop of material 12 from supply tube 222 through the exit nozzle 224 into liner 18 thereby delivering a uniform volume flow of material 12 into liner 18.

Figure 17:
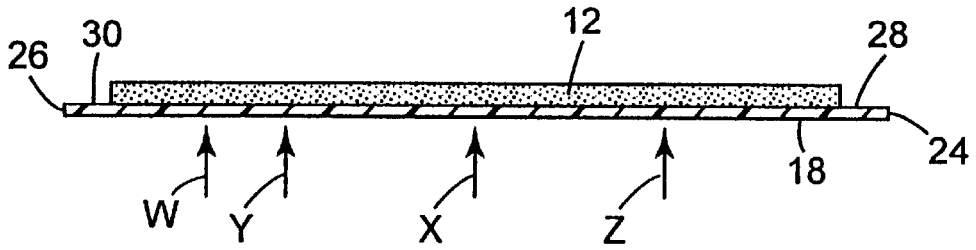
FIG. 17 is a side view of an unwrapped mass of material.

As previously mentioned, the method of wrapping a material 12 with a liner 18 may be described by the steps of: a) introducing a mass of material 12 onto the liner 18; b) folding liner 18; and c) spirally winding the wrapped mass of material 10 about itself. FIG. 17 illustrates an alternative embodiment of step a). FIG. 17 is a side view of an unwrapped mass of material. Positions X, Y, and Z are illustrated on liner 18 to indicate where folds are to be made in the material 12 and liner 18, as described in greater detail below. Material 12 is a layer introduced onto liner 18, extending between a first exposed region 28 and a second exposed region 30 of liner 18. Material 12 may be cured or polymerized by exposure to ultra violet light, for example, before folding liner 18.

Figure 18:
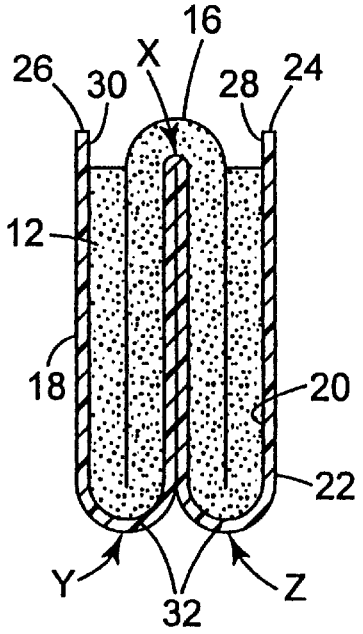
FIG. 18 is a cross-sectional view of one alternative wrapped mass of material.
Figure 19:
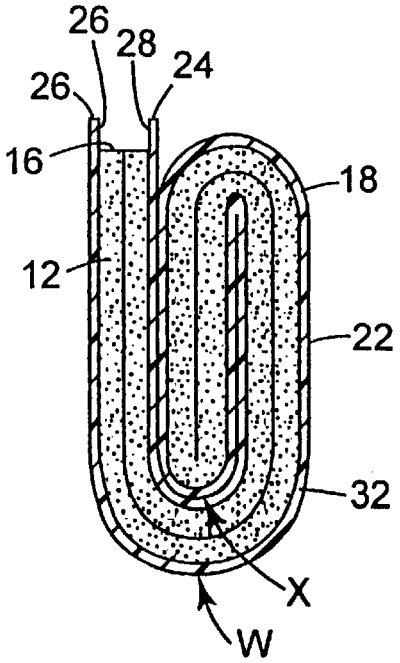
FIG. 19 is a cross-sectional view of a second alternative wrapped mass of material.

FIGS. 18 and 19 illustrate alternative wrapped masses; of the material of FIG. 17. FIG. 18 is a cross-sectional view of one alternative wrapped mass of material and FIG. 19 is a cross-sectional view of a second alternative wrapped mass of material 10.

The wrapped mass of material 10 illustrated in FIG. 18 is first formed as material 12 and liner 18, as illustrated in FIG. 17. Next, material 12 and liner 18 are folded lengthwise at position Y and position Z so that material 12 is folded onto itself. Then, material 12 and liner 18 are folded at position X so that liner 18 is folded back on itself to form the cross section illustrated in FIG. 18. Lastly, the wrapped material 10 is spirally wound about itself.

The wrapped mass of material 10 illustrated in FIG. 19 is first formed as material 12 and liner 18, as illustrated in FIG.

17. Next, material 12 and liner 18 are folded in half lengthwise at position X so that material 12 inside liner 18 is folded onto itself. Then, material 12 and liner 18 are folded to bring position X to the W position. Then, material 12 and liner 18 are folded at position W to form the cross section illustrated in FIG. 19. Lastly, the wrapped material 10 is spirally wound about itself.

The present invention has now been described with reference to several embodiments thereof. The foregoing detailed description and examples have been given for clarity of understanding only. No unnecessary limitations are to be understood therefrom. It will be apparent to those skilled in the art that many changes can be made in the embodiments described without departing from the scope of the invention. Thus, the scope of the present invention should not be limited to the exact details and structures described herein, but rather by the structures described by the language of the claims, and the equivalents of those structures.

What is claimed is:

1. A wrapped mass of material, comprising:

a) a flexible liner including an inside surface, an outside surface opposite said inside surface, a first edge, and a second edge opposite said first edge, wherein said inside surface includes a first exposed region extending along said first edge, a second exposed region extending along said second edge, and a center region extending between said first exposed region and said second exposed region; and b) a mass of material including a peripheral surface;

c) wherein said inside surface of said liner is at least partially wrapped around said peripheral surface of said mass of material forming a wrapped mass of material, and wherein said first exposed region of said liner faces said second exposed region; and d) wherein said wrapped mass of material is spirally wound about itself.

2. A wrapped mass of material according to claim 1, wherein said wrapped mass of material includes consecutive spirals of said wrapped mass of material, and wherein a second spiral of said wrapped mass of material is supported by a first spiral of wrapped mass of material adjacent said second spiral.

3. A wrapped mass of material according to claim 1, wherein said wrapped mass of material includes consecutive spirals of said wrapped mass of material, further including a reinforcing film interposed between said consecutive spirals of said wrapped mass of material.

4. A wrapped mass of material according to claim 1, in combination with a core, wherein said wrapped mass of material is spirally wound about said core.

5. A wrapped mass of material according to claim 1, wherein said liner is under tension so as to support said mass of material inside said liner.

6. A wrapped mass of material according to claim 1, wherein said mass of material includes an elongated cross-section.

7. A wrapped mass of material according to claim 1, wherein a portion of said peripheral surface of said mass of material remains exposed between said first edge and said second edge of said liner, forming an exposed surface of said mass of material.

8. A wrapped mass of material according to claim 1, wherein said first exposed region of said liner and said second exposed region of said liner are unbonded.

9. A wrapped mass of material according to claim 1, wherein said first exposed region of said liner and said second exposed region of said liner are bonded together.

10. A wrapped mass of material according to claim 1, wherein said mass of material comprises a cold-flowable material.

11. A wrapped mass of material according to claim 10, wherein said cold-flowable material comprises an adhesive.

12. A wrapped mass of material according to claim 11, wherein said adhesive comprises a hot-melt adhesive.

13. A wrapped mass of material according to claim 11, wherein said adhesive comprises a pressure sensitive adhesive.

14. A wrapped mass of material according to claim 10, wherein said cold-flowable material is subject to cold flow at 20° C.

15. A wrapped mass of material according to claim 12, wherein said liner is meltable and mixable with the hot melt adhesive so as to provide a coatable hot melt adhesive composition.

16. A wrapped mass of material according to claim 1, wherein said liner comprises a cloth including a silicone release coating on at least said inside surface of said liner.

17. A wrapped mass of material according to claim 1, in combination with a pallet including a first major surface and a second major surface opposite said first major surface, wherein said wrapped mass of material is supported by said first major surface.

18. A wrapped mass of material according to claim 17, further including a core, wherein said wrapped mass of material is spirally wound about said core and wherein said core is engaged with said first major surface of said pallet.

19. A wrapped mass of material according to claim 17, further including:

e) a spacer extending from said first major surface of said pallet;

f) a second pallet supported by said spacer, said second pallet including a first major surface and a second major surface; and g) a second wrapped mass of material supported by said first major surface of said second pallet.

20. A wrapped mass of material according to claim 1, wherein said mass of material is continuous.

21. A wrapped mass of material according to claim 1, wherein said liner is continuous.

22. A wrapped mass of material, comprising:

a) a mass of cold-flowable adhesive including an elongated cross-section and a peripheral surface;

b) a flexible liner having an inside surface, an outside surface opposite said inside surface, a first edge, and a second edge opposite said first edge, wherein said inside surface includes a first exposed region extending along said first edge, a second exposed region extending along said second edge, and a center region extending between said first exposed region and said second exposed region; and c) wherein said liner is wrapped around said mass, wherein said first exposed region faces said second exposed region, and wherein a portion of said peripheral surface of said material remains generally exposed.

23. A wrapped mass of hot melt adhesive, comprising:

a) a flexible liner including an inside surface, an outside surface opposite said inside surface, a first edge, and a second edge opposite said first edge, wherein said inside surface includes a first exposed region extending along said first edge, a second exposed region extending along said second edge, a center region extending between said first exposed region and said second exposed region;

b) a mass of hot melt adhesive including a peripheral surface, wherein said peripheral surface is in contact with said center region of said liner forming a wrapped mass of hot melt adhesive, wherein said first exposed region and said second exposed region of said liner extend away from said mass of hot melt adhesive, wherein said first exposed region faces said second exposed region, and wherein said first exposed region and said second exposed region of said liner are unbonded; and c) wherein said wrapped mass of hot melt adhesive is spirally wound about itself.

* * * * *